US007607847B2

(12) United States Patent
Yoshioka

(10) Patent No.: US 7,607,847 B2
(45) Date of Patent: Oct. 27, 2009

(54) PRINTER CAPABLE OF STABLE PRINTING WITHOUT PITCH FLUCTUATIONS AND PAPER CARRYING MECHANISM THEREFOR

(75) Inventor: Yukio Yoshioka, Kawasaki (JP)

(73) Assignee: NEC Infrontia Corporation, Kanagawa (JP)

( * ) Notice: Subject to any disclaimer, the term of this patent is extended or adjusted under 35 U.S.C. 154(b) by 329 days.

(21) Appl. No.: 11/519,870

(22) Filed: Sep. 13, 2006

(65) Prior Publication Data

US 2007/0059086 A1 Mar. 15, 2007

(30) Foreign Application Priority Data

Sep. 14, 2005 (JP) ..... 2005-266297

(51) Int. Cl.
*B41J 11/00* (2006.01)
*B41J 3/39* (2006.01)
*B41J 29/02* (2006.01)

(52) U.S. Cl. ..... 400/691; 400/693

(58) Field of Classification Search ..... 400/691, 400/693

See application file for complete search history.

(56) References Cited

U.S. PATENT DOCUMENTS 6,573,925 B2 * 6/2003 Ohmura et al. ..... 347/262

FOREIGN PATENT DOCUMENTS

JP 9-240083 A 9/1997

* cited by examiner

*Primary Examiner*—Judy Nguyen
*Assistant Examiner*—Marissa L Ferguson-Samreth
(74) *Attorney, Agent, or Firm*—Sughrue Mion, PLLC

(57) ABSTRACT

In a printer including a base frame, an upper frame rotatably coupled to the base frame, and a platen and a platen pulley both rotatably supported by the upper frame, a subframe is attached to the upper frame rotatably and movably in one direction. A reduction gear and a belt pulley both are rotatably supported by the subframe. A drive gear is rotatably supported by the base frame and engaged with the reduction gear. A drive belt is stretched between the platen pulley and the belt pulley. A spring is attached between the upper frame and the subframe. The base frame has a guiding portion concentric with the drive gear. The subframe has a guided portion opposite the guiding portion. The spring applies tension to the drive belt and brings the guided portion into contact with the guiding portion.

18 Claims, 5 Drawing Sheets

RELATED ART

PRINTER CAPABLE OF STABLE PRINTING WITHOUT PITCH FLUCTUATIONS AND PAPER CARRYING MECHANISM THEREFOR

This application claims priority to prior application JP 2005-266297, the disclosure of which is incorporated herein by reference.

BACKGROUND OF THE INVENTION

The present invention relates to a printer used in point-of-sale (POS) terminals, cash registers, photocopiers, and facsimiles, and to a paper carrying mechanism therefor.

For example, Japanese Unexamined Patent Application Publication No. 9-240083 discloses a printer having a structure such that an upper frame is rotatably attached to a base frame and the upper frame has a platen and so on provided therein. This type of printer generally employs one of the following first and second drive systems.

First, a first drive system will be described with reference to FIG. 1.

An upper frame 32 is attached to a base frame 31 with a fulcrum shaft 33 rotatably rightward by a slight angle from the shown position. The base frame 31 includes a drive motor 34, a drive gear 35 fixed to a rotating shaft (not shown) of the drive motor 34, a first reduction gear 36 engaged with the drive gear 35, and a second reduction gear 37 coaxial with the first reduction gear 36.

The upper frame 32 includes a platen gear 38 and a platen 39 coaxial with the platen gear 38.

When the drive motor 34 rotates, the torque is transmitted to the platen 39 via the drive gear 35, the first reduction gear 36, the second reduction gear 37, and the platen gear 38.

In the first drive system, the distances between the shaft of the drive gear 35, the shaft of the first reduction gear 36 and the second reduction gear 37, and the shaft of the platen gear 38 are not maintained constant. Therefore, the amount of backlash between the drive gear 35 and the first reduction gear 36, and the amount of backlash between the second reduction gear 37 and the platen gear 38 are not stable. Therefore, pitch fluctuations tend to occur in the printing.

Next, a second drive system will be described with reference to FIG. 2.

An upper frame 42 is attached to a base frame 41 with a fulcrum shaft 43 rotatably rightward by a slight angle from the shown position. The base frame 41 includes a drive motor 44, a drive gear 45 fixed to a rotating shaft (not shown) of the drive motor 44, and a first reduction gear 46 engaged with the drive gear 45.

The upper frame 42 includes a second reduction gear 47, a reduction pulley 48 coaxial with the second reduction gear 47, a platen pulley 50, a belt 49 stretched around the reduction pulley 48 and the platen pulley 50, a platen 51 coaxial with the platen pulley 50, and a tension roller 52 applying tension to the belt 49.

When the drive motor 44 rotates, the torque is transmitted to the platen 51 via the drive gear 45, the first reduction gear 46, the second reduction gear 47, the reduction pulley 48, the belt 49, and the platen pulley 50.

In the second drive system, in order to deal with a variation in the length of the belt 49 and to maintain the tension of the belt 49 constant, a tension roller 52 is adopted. However, this tends to complicate the structure. In addition, this does not solve the above-described problem concerning the amount of backlash.

SUMMARY OF THE INVENTION

It is therefore an object of the present invention is to provide a printer capable of stable printing without pitch fluctuations.

It is another object of the present invention is to provide a printer that can easily deal with a variation in the length of a belt that rotates a platen pulley.

It is still another object of the present invention is to provide a printer that can stabilize the amount of backlash of gears in a power transmission system.

It is yet another object of the present invention is to provide a paper carrying mechanism for the above-described printer.

Other objects of the present invention will become clear as the description proceeds.

According to an aspect of the present invention, there is provided a paper carrying mechanism for a printer which comprises a base frame, an upper frame rotatably coupled to the base frame, a platen and a platen pulley both rotatably supported by the upper frame, a subframe attached to the upper frame rotatably and movably in one direction, a reduction gear and a belt pulley both rotatably supported by the subframe, a drive gear rotatably supported by the base frame and engaged with the reduction gear, a drive belt stretched between the platen pulley and the belt pulley, and a spring attached between the upper frame and the subframe, the base frame having a guiding portion concentric with the drive gear, the subframe having a guided portion opposite the guiding portion, the spring applying tension to the drive belt and brings the guided portion into contact with the guiding portion.

According to another aspect of the present invention, there is provided a printer which comprises a base frame, an upper frame rotatably coupled to the base frame, a platen and a platen pulley both rotatably supported by the upper frame, a subframe attached to the upper frame rotatably and movably in one direction, a reduction gear and a belt pulley both rotatably supported by the subframe, a drive gear rotatably supported by the base frame and engaged with the reduction gear, a drive belt stretched between the platen pulley and the belt pulley, and a spring attached between the upper frame and the subframe, the base frame having a guiding portion concentric with the drive gear, the subframe having a guided portion opposite the guiding portion, the spring applying tension to the drive belt and brings the guided portion into contact with the guiding portion.

DESCRIPTION OF THE PREFERRED EMBODIMENT

Figure 1:
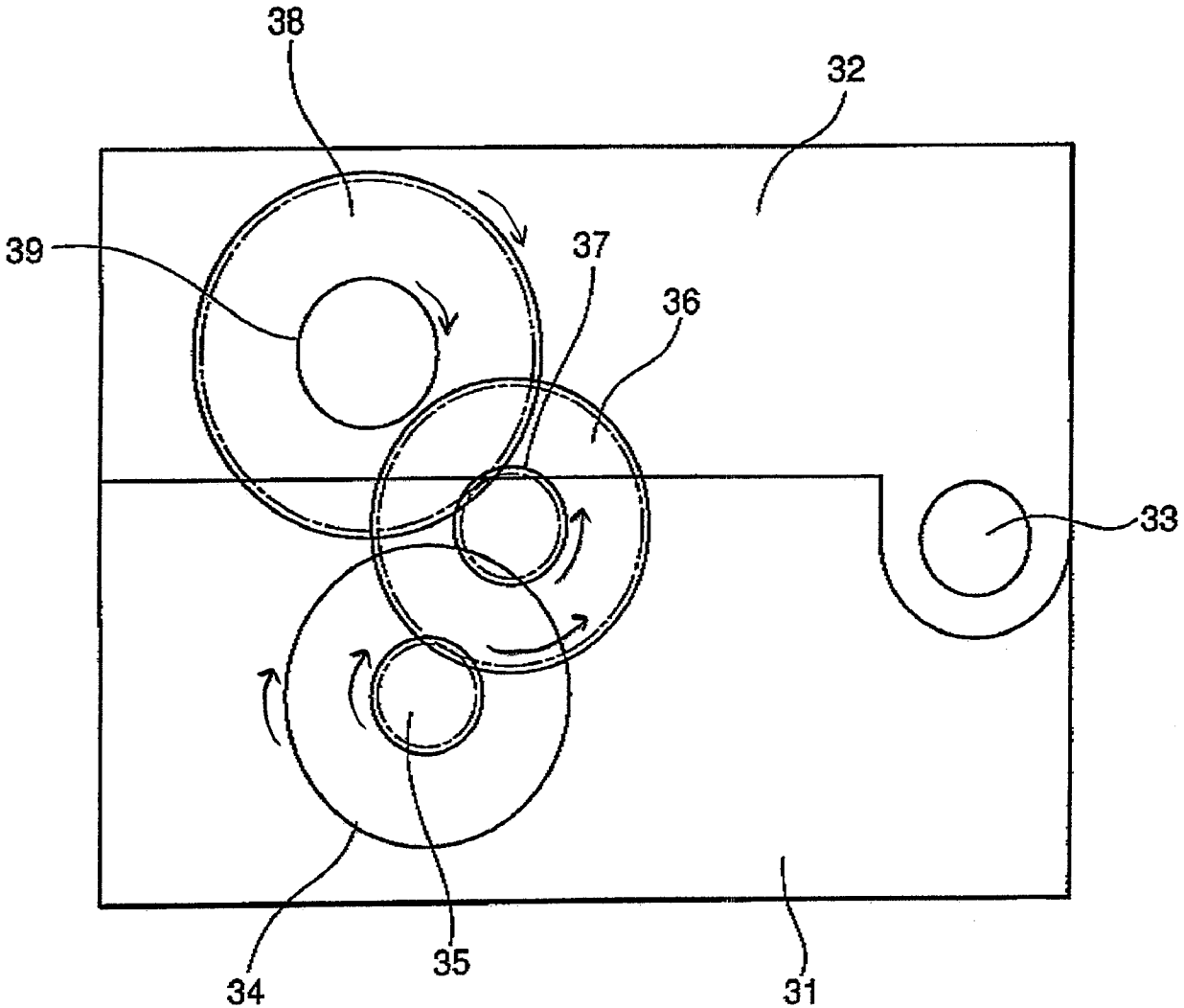
FIG. 1 is a schematic view of a first drive system of a conventional printer.
Figure 2:
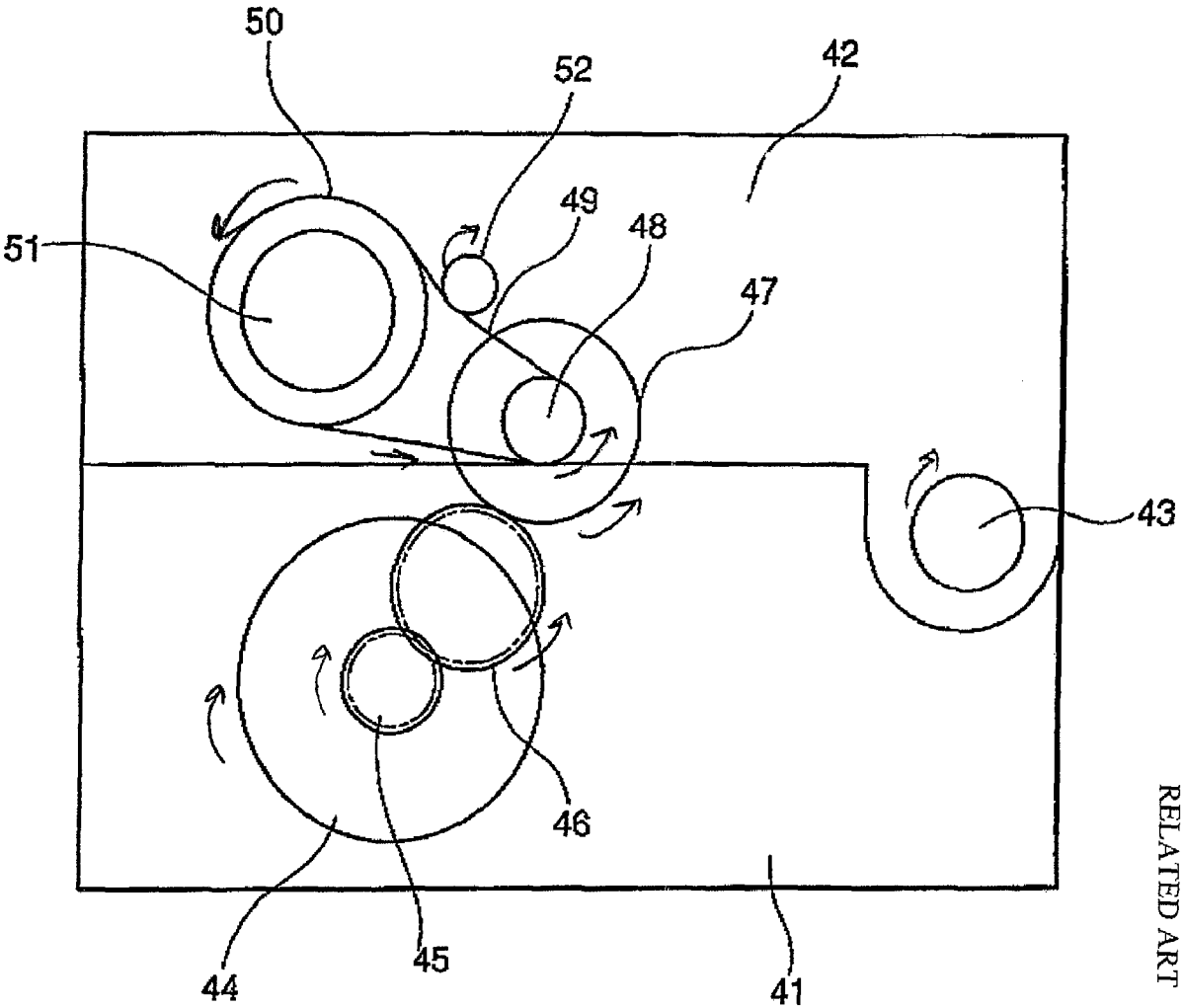
FIG. 2 is a schematic view of a second drive system of a conventional printer.
Figure 3:
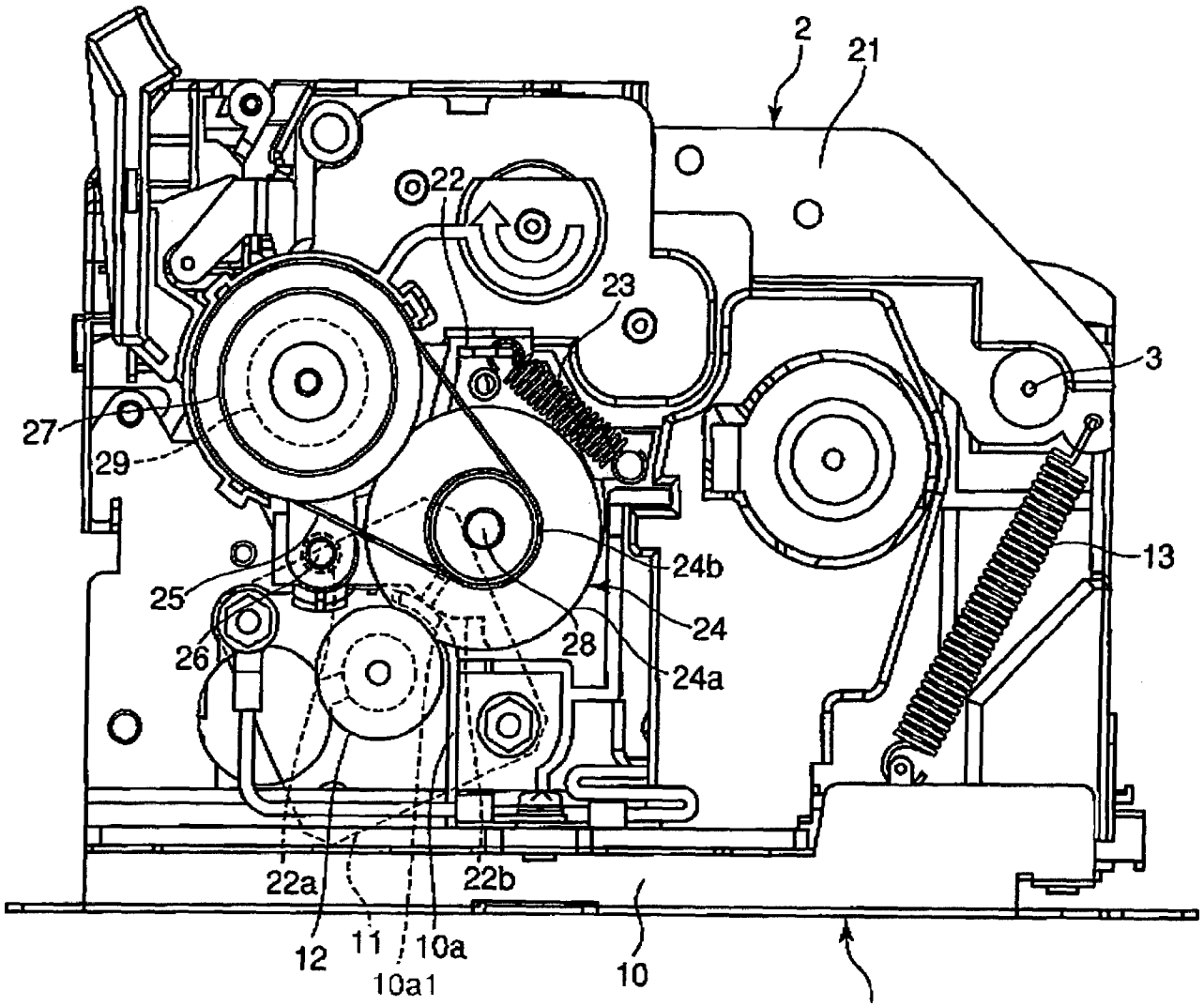
FIG. 3 is a side view showing a printer according to an embodiment of the present invention.
Figure 4:
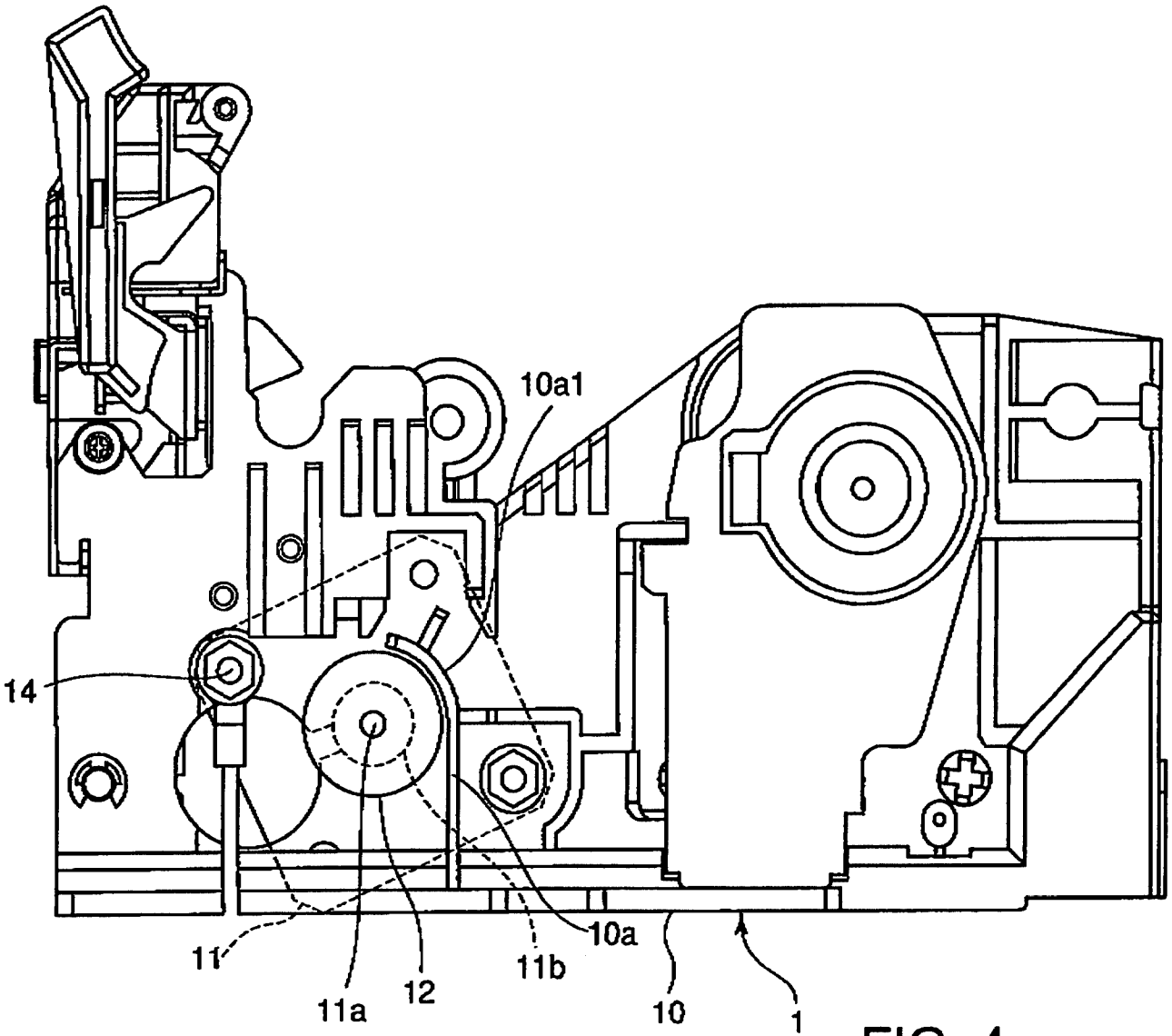
FIG. 4 is a side view of a fixed portion included in the printer of FIG. 3.
Figure 5:
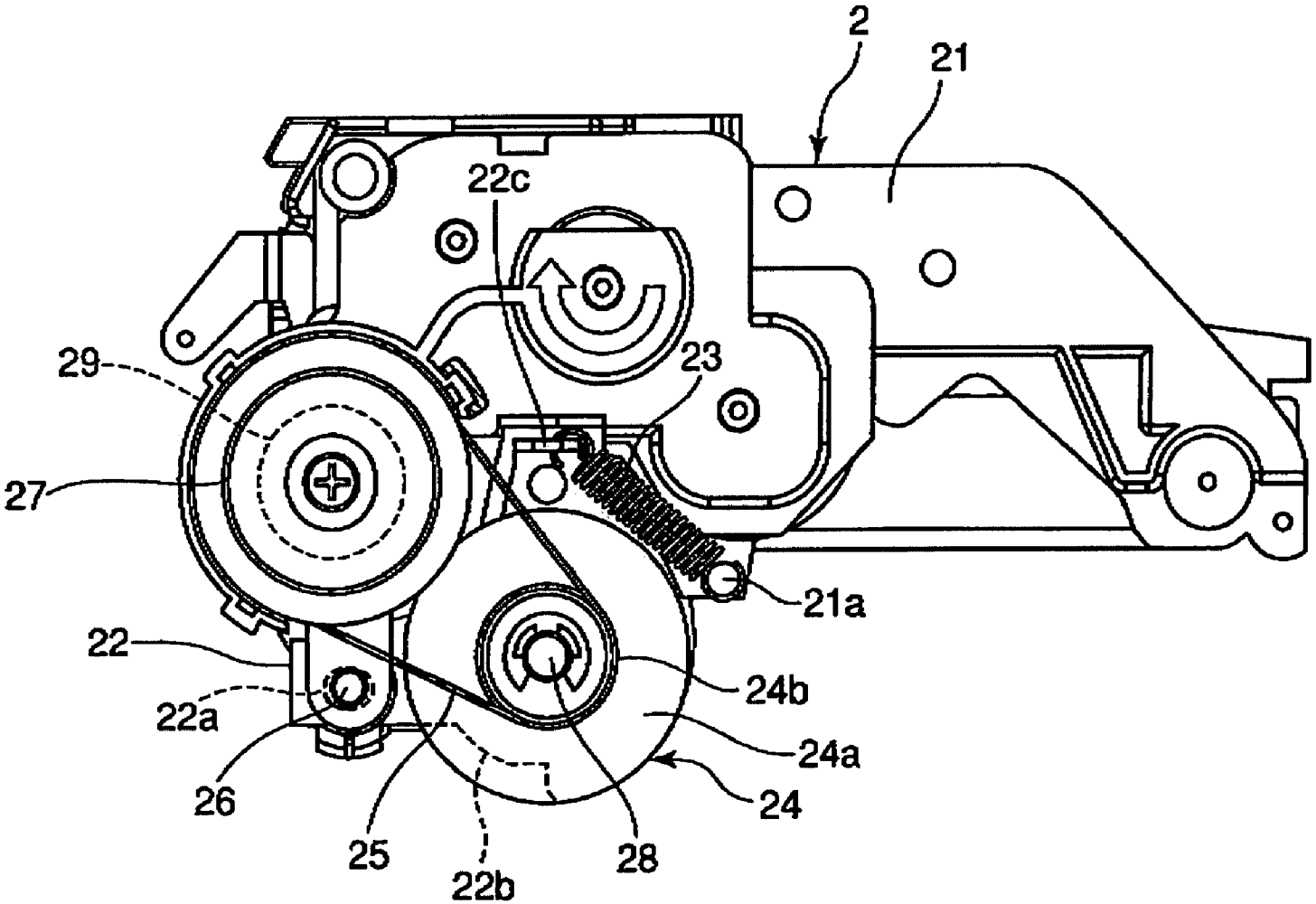
FIG. 5 is a side view of a movable portion included in the printer of FIG. 3.

With reference to FIGS. 3 to 5, description will be made as regards a printer according to an embodiment of the present invention, and more specifically, a paper carrying mechanism therefor.

The shown printer includes a fixed portion 1 having a base frame 10, and a movable portion 2 having an upper frame 21. The upper frame 21 is rotatably, that is to say, openably and closably attached to the base frame 10 with an attachment shaft 3. An opening coil spring 13 is attached between the upper frame 21 and the base frame 10 to give the upper frame 21 a moving force, that is to say, an opening force.

The base frame 10 includes a drive motor 11 shown by a dashed square, and a drive gear 12 attached to a motor shaft 11*a* of the drive motor 11. The drive motor 11 is attached to the base frame 10 with two screws 14. In addition, the base frame 10 has a hole (not shown) for positioning a bearing 11*b* of the drive motor 11, and a rib 10*a* having a guiding portion 10*a*1, which includes a curved surface concentric with the drive gear 12. The rib 10*a* is a curved plate vertically provided on the inner bottom of the base frame 10.

The upper frame 21 includes a platen 29 for carrying paper with a known technique, and a platen pulley 27 coaxial with the platen 29 for driving the platen 29. In addition, the upper frame 21 has a subframe 22 attached thereto.

The subframe 22 is rotatable around a fulcrum shaft 26 having a round cross section provided in the upper frame 21, and has a subframe stud 28. To the subframe stud 28, an idle gear 24 is rotatably attached. The idle gear 24 has a reduction gear 24*a* and a small belt pulley 24*b*. The small belt pulley 24*b* has teeth around the outer periphery thereof.

Between the platen pulley 27 and the small belt pulley 24*b*, a drive belt 25 is stretched. The drive belt 25 has teeth on the inner surface thereof. Therefore, the driving force of the drive motor 11 is sequentially transmitted to the drive gear 12, the reduction gear 24*a*, the small belt pulley 24*b*, the drive belt 25, the platen pulley 27, and the platen 29. With the rotation of the platen 29, paper is carried.

A tension coil spring 23 is attached between the upper frame 21 and the subframe 22. The lower right end of the coil spring 23 is hooked to a protrusion 21*a* of the upper frame 21, and the upper left end thereof is hooked to a hole 22*c* of the subframe 22. A rightward rotation of the subframe 22 around the fulcrum shaft 26 applies tension to the drive belt 25.

The subframe 22 has a rotation fulcrum hole 22*a* in which the fulcrum shaft 26 of the upper frame 21 is fitted. In order to ensure smooth rotation of the subframe 22 in spite of a variation in the length of the drive belt 25, the rotation fulcrum hole 22*a* has an elongated shape (for example, the shape of an athletics track) in one direction perpendicular to the rotation axis of the subframe 22. In this way, the subframe 22 is attached to the upper frame 21 by a structure such that a round shaft is fitted in an elongated hole. Therefore, the subframe 22 can rotate and move in the above-mentioned one direction relative to the upper frame 21.

In addition, the subframe 22 has a curved surface (guided portion) 22*b* formed in the lower part thereof, which is concentric with the idle gear 24. When the upper frame 21 is closed, the curved surface 22*b* of the subframe 22 smoothly comes into contact with the curved surface 10*a*1 of the base frame 10. Therefore, the distance between the shaft of the drive gear 12 and the shaft of the idle gear 24 is maintained constant. In addition, since the curved surface 22*b* is concentric with the reduction gear 24*a*, the reduction gear 24*a* can be accurately engaged with the drive gear 12.

The idle gear 24 is pressed against the drive gear 12 at a constant load by the tension of the coil spring 23. That is to say, the function of the coil spring 23 is to apply tension to the drive belt 25 and to press the idle gear 24 against the drive gear 12.

Therefore, the amount of backlash of the drive gear 12 and the reduction gear 24*a* is invariable. Therefore, paper is stably carried, and the printer is capable of stable printing without pitch fluctuations.

While the present invention has thus far been described in connection with a few embodiments thereof, it will readily be possible for those skilled in the art to put this invention into practice in various other manners. For example, although the paper carrying mechanism of the printer has been mainly described above, it is a matter of course that the printer may also has other components and other functions of various conventional printers of the type.

What is claimed is:

1. A paper carrying mechanism for a printer which comprises:

a base frame;

an upper frame rotatably coupled to the base frame;

a platen and a platen pulley both rotatably supported by the upper frame;

a subframe attached to the upper frame rotatably and movably in one direction;

a reduction gear and a belt pulley both rotatably supported by the subframe;

a drive gear rotatably supported by the base frame and engaged with the reduction gear;

a drive belt stretched between the platen pulley and the belt pulley; and a spring attached between the upper frame and the subframe, the base frame having a guiding portion concentric with the drive gear, the subframe having a guided portion opposite the guiding portion, the spring applying tension to the drive belt and brings the guided portion into contact with the guiding portion.

2. The paper carrying mechanism according to claim 1, wherein the subframe is attached to the upper frame by a structure such that a round shaft is fitted in an elongated hole.

3. The paper carrying mechanism according to claim 1, wherein the subframe has a fulcrum hole, the upper frame has a fulcrum shaft inserted in the fulcrum hole, the fulcrum hole is an elongated hole in the one direction, and the fulcrum shaft is a round shaft.

4. The paper carrying mechanism according to claim 1, wherein the guiding portion and the guided portion respectively have curved surfaces in contact with each other.

5. The paper carrying mechanism according to claim 4, wherein the curved surfaces face in the opposite direction from each other.

6. The paper carrying mechanism according to claim 1, wherein the guided portion is concentric with the reduction gear.

7. The paper carrying mechanism according to claim 1, wherein the base frame has a rib vertically provided on the inner bottom thereof, and the rib is a curved plate having the guiding portion.

8. The paper carrying mechanism according to claim 1, wherein the spring is a tension coil spring, and the tension coil spring has a first end hooked to the upper frame and a second end hooked to the subframe.

9. The paper carrying mechanism according to claim 8, wherein the upper frame has a protrusion, the subframe has a hole, the first end is hooked to the protrusion, and the second end is hooked to the hole.

10. A printer comprising:

a base frame;

an upper frame rotatably coupled to the base frame;

a platen and a platen pulley both rotatably supported by the upper frame;

a subframe attached to the upper frame rotatably and movably in one direction;

a reduction gear and a belt pulley both rotatably supported by the subframe;

a drive gear rotatably supported by the base frame and engaged with the reduction gear;

a drive belt stretched between the platen pulley and the belt pulley; and a spring attached between the upper frame and the subframe, the base frame having a guiding portion concentric with the drive gear, the subframe having a guided portion opposite the guiding portion, the spring applying tension to the drive belt and brings the guided portion into contact with the guiding portion.

11. The printer according to claim 10, wherein the subframe is attached to the upper frame by a structure such that a round shaft is fitted in an elongated hole.

12. The printer according to claim 10, wherein the subframe has a fulcrum hole, the upper frame has a fulcrum shaft inserted in the fulcrum hole, the fulcrum hole is an elongated hole in the one direction, and the fulcrum shaft is a round shaft.

13. The printer according to claim 10, wherein the guiding portion and the guided portion respectively have curved surfaces in contact with each other.

14. The printer according to claim 13, wherein the curved surfaces face in the opposite direction from each other.

15. The printer according to claim 10, wherein the guided portion is concentric with the reduction gear.

16. The printer according to claim 10, wherein the base frame has a rib vertically provided on the inner bottom thereof, and the rib is a curved plate having the guiding portion.

17. The printer according to claim 10, wherein the spring is a tension coil spring, and the tension coil spring has a first end hooked to the upper frame and a second end hooked to the subframe.

18. The printer according to claim 17, wherein the upper frame has a protrusion, the subframe has a hole, the first end is hooked to the protrusion, and the second end is hooked to the hole.

* * * * *